US005295893A

United States Patent [19]

Chiu

[11] Patent Number: 5,295,893

[45] Date of Patent: Mar. 22, 1994

[54] DRIVING STRUCTURE FOR A TOY ANIMAL

[76] Inventor: Chien-Wang Chiu, P.O. Box 96-405, Taipei 10098, Taiwan

[21] Appl. No.: 2,988

[22] Filed: Jan. 11, 1993

[51] Int. Cl.[5] ..... A63H 11/20

[52] U.S. Cl. ..... 446/356; 446/278

[58] Field of Search ..... 446/356, 354, 355, 353, 446/368, 293, 294, 278

[56] References Cited

U.S. PATENT DOCUMENTS 4,519,788 5/1985 Ajiro et al. ..... 446/356
4,613,315 9/1986 Kataoka ..... 446/355
4,680,022 7/1987 Hoshino et al. ..... 446/356 X

FOREIGN PATENT DOCUMENTS 1258316 3/1961 France ..... 446/356

*Primary Examiner*—Mickey Yu

*Attorney, Agent, or Firm*—Bacon & Thomas

[57] ABSTRACT

An animal-like-toy driving structure, which includes an animal-like skin and a supporting casing to be mounted in the animal-like skin; two displacing plates on both sides of the supporting casing are inserted in the feet of the animal-like toy respectively; the front end of the supporting casing is movably connected with a rotary mechanism casing, of which the front end is mounted around with a ring-shaped belt that has two symmetrical swinging arms to be inserted into the front feet of the animal-like toy respectively; two bias wheels on both sides of the rotary mechanism casing have two cam studs respectively to be aligned on one center line; when a transmission structure inside the rotary mechanism casing is turning, the rotary mechanism casing will turn, and cause the ring-shaped belt to swing and move forward and the whole animal-like toy will wriggle and move forward.

5 Claims, 5 Drawing Sheets

DRIVING STRUCTURE FOR A TOY ANIMAL

BACKGROUND OF THE INVENTION

1. Field of the Invention

This invention relates to an animal-like-toy driving structure, and particularly to a supporting casing covered with an animal-like skin able to wriggle and move forwards by means of a rotary mechanism casing driven with a motor.

2. Description of the Prior Art

In the prior art, there are toys, which are covered with an animal-like skins, such as Taiwan patent applications Nos. 76211780, 76203206, and 76211473; the aforesaid toys are designed as different animals capable of moving forward. Each of them has a supporting casing covered with an animal-like skin. The supporting casing contains a transmission structure, which is driven by a motor as the major driving power source. The driving power is transmitted through a retarding gear train and a crank shaft, which can directly or indirectly actuate four movable rods in the feet of an animal-like toy. When the four rods move, the animal-like toy also moves forward. Since the head of this animal-like toy is linked with the transmission structure in the toy, the head also wings or mores up and down.

Another kind of animal-like toy is shown and described under Taiwan patent applications Nos. 75208591 and 7323912, each of disclose an animal-like toy able to skip forward. Such toy usually comprises a supporting casing with a transmission structure therein, a crank shaft, four movable rods in the four feet of the toy, a link rod or a cam. As soon as the link rod or the cam drives the rear feet of the animal-like toy, the rear feet will skip at once to cause the toy to skip forward.

Still another kind of animal-like toy under Taiwan patent application No. 75206234 is also covered with an animal-like skin, in which a supporting casing with a transmission structure is mounted. The transmission structure is coupled with two sets of crank shafts, of which one set is connected with two feet for moving forward, while the other set is connected with two. soft plates as hands of the toy. When the animal-like toy moves forward, the two hands thereof are caused to swing.

A further another animal-like toy under Taiwan patent application No. 77211734 is also covered with an animal-like skin being fixedly attached to the lower part of the body thereof. The upper portion of the body is coupled to a transmission structure inside the body to impart a swinging motion which is provided by means of a motor, a retarding gear train, a bias wheel to actuate a link rod. The link rod enables the toy to swing laterally, while the bias wheel enables the toy to swing back and forth.

All the aforesaid toys each have an animal-like skin to cover a supporting casing which contains a motor, a retarding gear train, a link rod or a bias wheel or a crank shaft for imparting different motions to the toy.

SUMMARY OF THE INVENTION

This invention provides an animal-like-toy driving structure. The toy comprises an animal-like skin made of a soft plastic material; inside the animal-like skin, a supporting casing with a bottom plate thereunder are installed; and a cap plate is used for fastening the animal-like skin in place. The supporting casing has two displacing plates inserted into two feet. The front end of the supporting casing is pivotally connected with a rotary mechanism casing, which can provide the toy with a moving forward motion and a wriggling motion.

In the present invention, the symmetrical supporting arms on the front end of the supporting casing have two round holes respectively for receiving two cam studs on two bias wheels; the upper front end of the supporting casing has an extension plate with a curvature slot for receiving a swinging link on the rotary mechanism casing; when a transmission structure inside the rotary mechanism casing rotates, the rotary mechanism casing will be driven to swing laterally, and up and down. When the rotary mechanism casing swings, the animal-like skin of the toy will move and wriggle because the transmission structure therein is in contact with the outer skin.

In the present invention, the front end of the rotary mechanism casing has two extension arms for holding a motor in place with two hook portions. A ring-shaped belt is mounted around the motor; the lower side of the ring-shaped belt has two symmetrical swinging arms, which can move up and down, and forward when the rotary mechanism casing swings. Since the two swinging arms are inserted in the two front feet of the animal-like skin, the animal like toy looks like it moves forward when the rotary mechanism casing moves.

In the present invention, the center parts of the two bias wheels are mounted on both ends respectively of a square transmission shaft; each of the bias wheels has a convex surface with a cam stud being perpendicular to the convex surface. The cam studs are movably mounted in two round holes respectively on two symmetrical supporting arms on the front side of the supporting casing. When the bias wheels rotate, the cam studs on the bias wheels become a center shaft of the rotary mechanism casing, which, upon being driven, swings. The swinging angle of the rotary mechanism casing is limited by the curvature slot in the extension plate on the supporting casing so as to have the rotary mechanism casing move up and down, and laterally in a regular manner. In that case, the swinging arms on both sides of the ring-shaped belt will also move forward, and simultaneously the animal-like skin will move in a wriggling manner.

In the toy of the present invention, a battery chamber is provided in the supporting casing, and it is a power source of the toy; one side of the supporting casing is mounted with a printed circuit board to generate a sound, while the bottom of the supporting casing has a bottom plate mounted with a loudspeaker, which can produce an animal roar when the toy moves.

DETAILED DESCRIPTION OF THE PREFERRED EMBODIMENT

Figure 1:
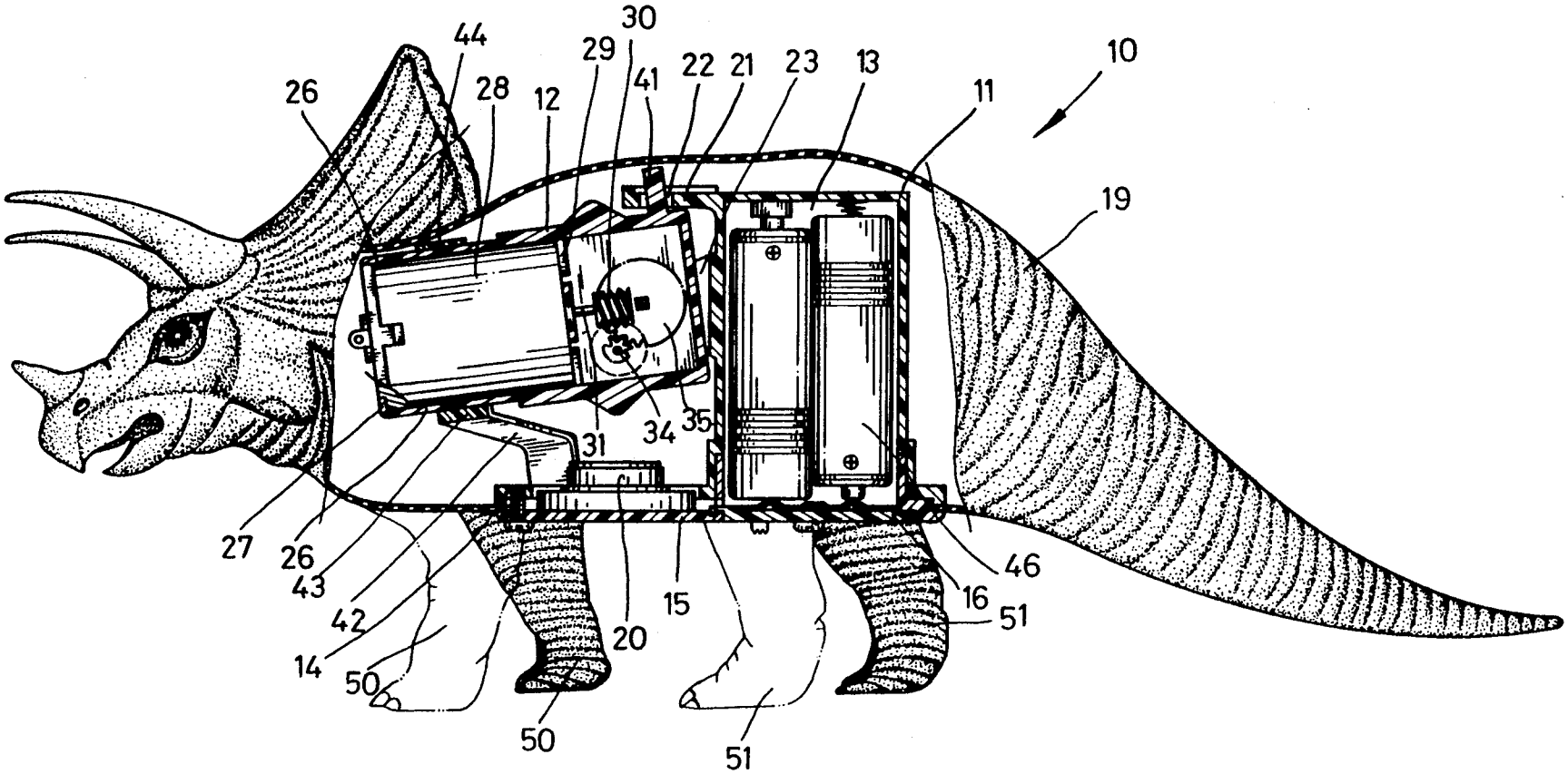
FIG. 1 is a sectional view of the present invention, showing the structure relationship of various parts and the outer skin of an animal.

This invention provides an animal-like-toy driving structure. Referring to FIGS. 1 to 4, the toy driving structure comprises a supporting casing 11 with a plurality of displacing plates on both sides thereof. The front part of the supporting casing 11 is mounted with a rotary mechanism casing 12, of which the front side has two symmetrical extension arms 26 mounted under a ring-shaped belt 43. Both sides of the ring-shaped belt 43 are furnished with two symmetrical swinging arms 42. The animal-like toy 10 is covered with an animal-like skin 19. The displacing plates 25 on both sides of the supporting casing 11 are inserted into two rear feet 51 respectively. Both sides of the lower side of the ring-shaped belt 43 are furnished with two swinging arms 42 to be inserted into two front feet 50 respectively. The power of the animal-like toy 10 is supplied by a battery 46 in a battery chamber 13 of the supporting casing 11 to drive a motor 28 in the front part of the rotary mechanism casing 12. The motor 28 is the source of the dynamic force of the toy. The rotary mechanism casing 12 has a transmission structure to actuate two bias wheels 37 on both sides of the rotary mechanism casing 12. Each bias wheel 37 has a cam stud 38. When the bias wheel 37 rotates, the rotary mechanism casing 12 will swing to cause the swinging arms 42 to swing and to move forward through the extension arms 26 so that the animal-like toy looks like a live animal. The animal-like toy 10 is covered with an animal-like skin 19, which is similar to a model of a dinosaur. The skin 19 is made of a soft plastic material. The skin 19 also has some supporting force in itself even without the supporting casing. In the animal-like skin 19, only the lower side of the supporting casing 11 and the four feet 50 and 51 are actually attached to the skin 19. In other words, the remaining portions of the skin are not fixedly attached to the supporting mechanism. As soon as the rotary mechanism casing 12 is moved, the ring-shaped belt 43 attached to the extension arms 26 will be driven to move. Simultaneously, the swinging arm 42 inside the skin 19 for the front feet 50 will swing and move forwards. The whole animal-like skin 19 on the rotary mechanism casing 12 will also wriggle forward, in a manner similar to a real dinosaur.

Figure 2:
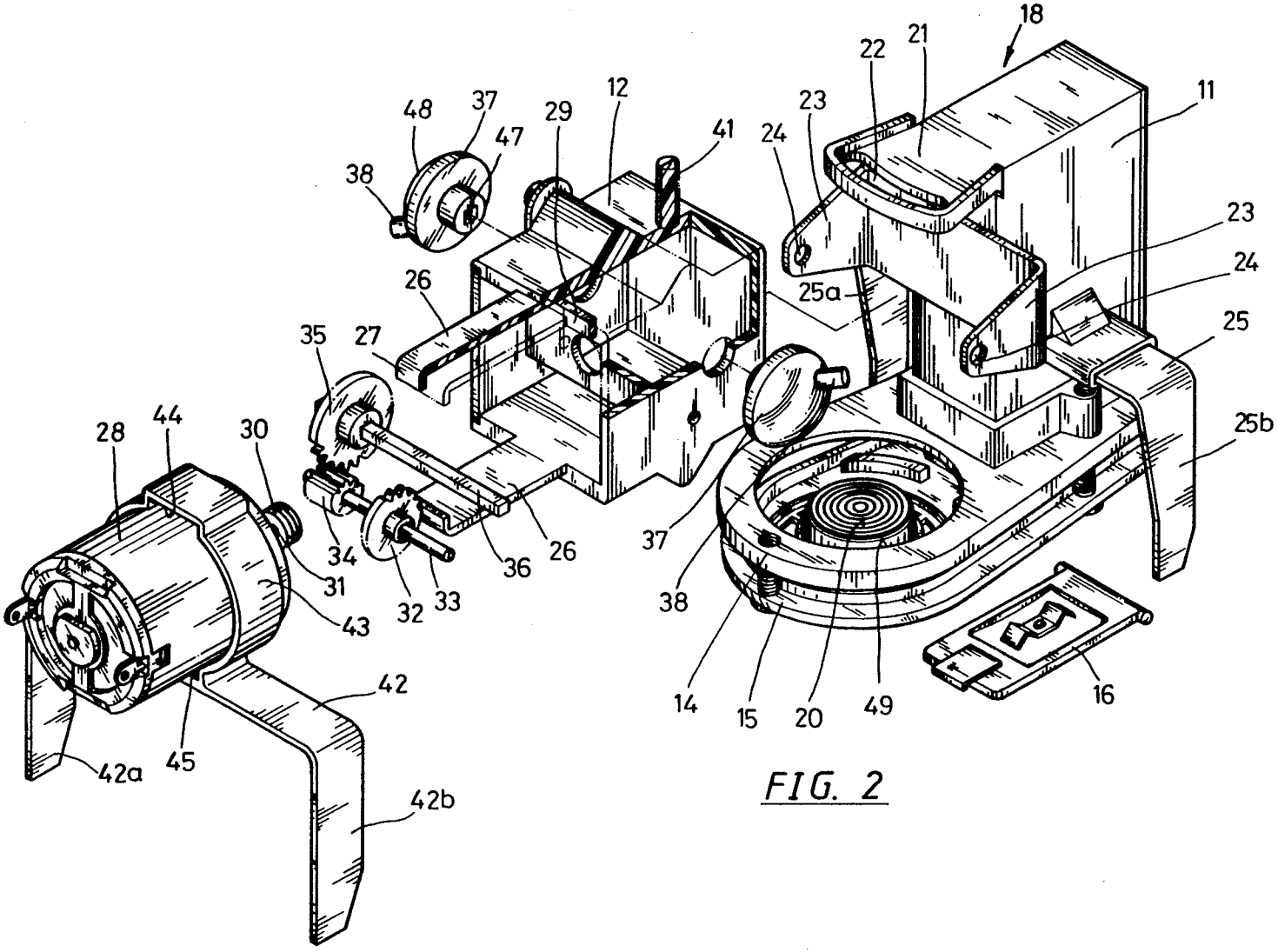
FIG. 2 is a disassembled view of the transmission structure among assemblies according to the present invention.
Figure 3:
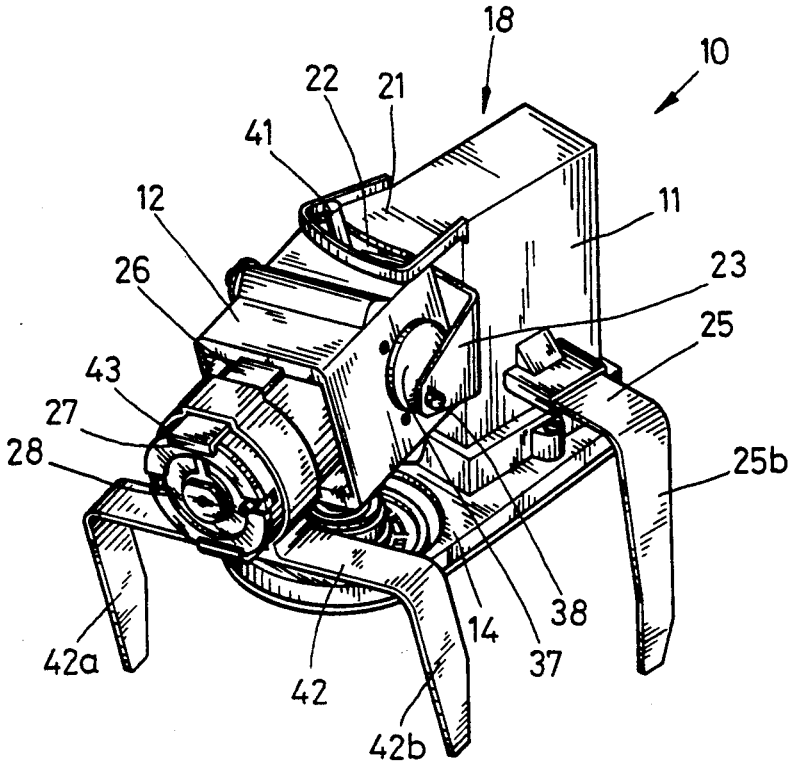
FIG. 3 is a perspective view of the transmission structure among assemblies according to the present invention.
Figure 4:
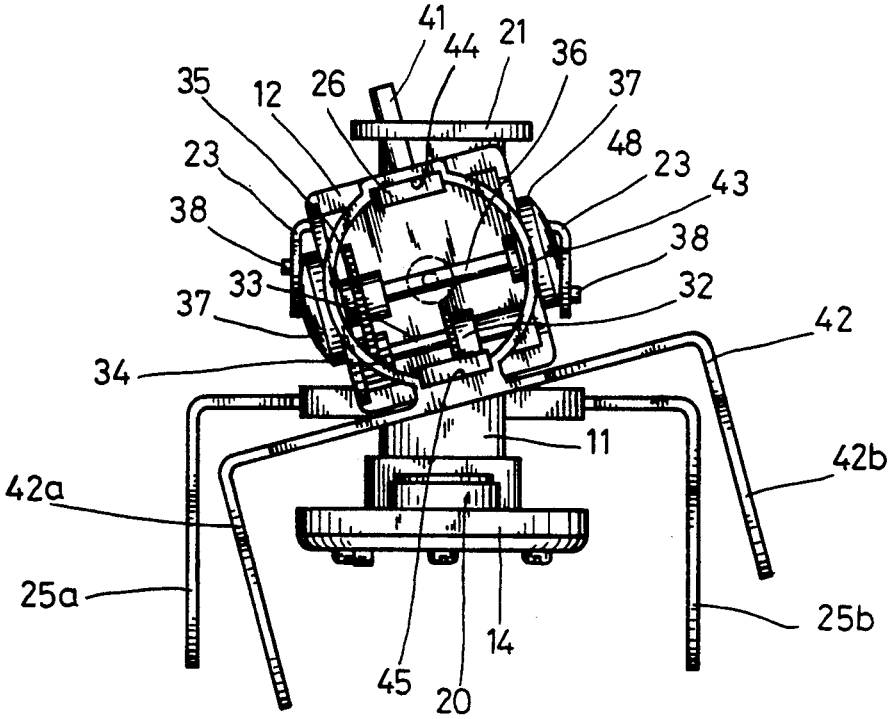
FIG. 4 is a front view of some assemblies of the present invention, showing the transmission structure mounted in a rotary' mechanism casing.

As shown in FIGS. 1 to 3, the animal-like toy 10 has a supporting casing 11 as the connecting frame so as to support the rotary mechanism casing 12 in place. Both sides of the supporting casing 11 are mounted with two symmetrical displacing plates 25 respectively, which are inserted into two rear feet 51 respectively of the animal-like skin. The bottom side of the supporting casing 11 is mounted with a bottom plate 14 having a round hole 49. The supporting casing 11 of the animal-like toy 10 is tucked in the animal-like skin 19. The opening of the animal-like skin 19 is located under the bottom plate 14 of the supporting casing 11, and it is fastened in place with a cap plate 15 and screws. A battery chamber 13 is furnished inside the supporting casing 11, and is closed with a battery chamber cap 16 to facilitate replacement of the battery. The top front side of the supporting casing 11 has an extension plate 21 with a curvature slot 22 for receiving a swinging link 41 on the rotary mechanism casing 12 so as to limit the swinging angle of the rotary mechanism casing 12. The supporting arms 23 with two round holes 24 on both ends thereof are attached between the bottom plate 14 and the extension plate 21. The two round holes 24 are used for receiving two cam studs 38 of the two bias wheels 37 on both sides of the rotary mechanism casing 12.

As shown in FIGS. 1 to 4, the rotary mechanism casing 12 of the animal-like toy 10 is the power source and transmission assembly of the present invention. The rotary mechanism casing 12 is mounted in the front part of the supporting casing 11. The main driving assembly of the animal-like toy is the rotary mechanism casing 12, which is pivotally mounted in the front end of the supporting casing 11 to provide a wriggling and swinging movement for the toy 10. A square transmission shaft 36 in the rotary mechanism casing 12 is mounted with two bias wheels 37 on both ends thereof. Each of the bias wheels 37 has a cam stud 38 on the outer side thereof. The two cam studs 38 of the bias wheels 37 are pivotally engaged in two round holes 24 respectively of the two supporting arms 23 by using a co-center shaft. The cam studs 38 of the two bias wheels 37 of rotary mechanism casing 12 become a center shaft so as to produce a rotary and swinging motion.

The front side of the rotary mechanism casing, 12 of the toy 10 is furnished with two symmetrical extension arms 26, while the inside of the rotary mechanism casing 12 has a partition plate 29. The space formed with the two extension arms 26 and the partition plate 29 is used for receiving a motor 28. The front end of the motor 28 is in contact with the partition plate 29, and the screw rod 30 of the motor shaft 31 extends through the partition plate 29, and engages with a rotary gear 32. The outer end of the motor 28 is engaged by the hook portions 27 of the extension arms 26 so as to fasten the motor in place. When the motor 28 is driven to turn, the motor does not make self-rotation because of being fixed in plate. The inside of the rotary mechanism casing 12 is installed with a transmission structure, which includes a motor shaft 31 having a screw rod 30, a transmission shaft 33 mounted with a rotary gear 32 and a driving gear 34. A square transmission shaft 36 is mounted with a driven gear 35. Both ends of the shaft 36 are mounted with two bias wheels 37 respectively through the square holes 47 of the bias wheels. The rotary gear 32 on the transmission shaft 33 is engaged with the screw rod 30 of the motor shaft 31. The driving gear 34 on the shaft 33 is engaged with the driven gear 35 on the square transmission shaft 36. When the motor 28 runs, the screw rod 30 transmits a driving power to the rotary gear 32 on the transmission shaft 33 which in turn is transmitted through the driving gear 34 on the transmission shaft 33 to the driven gear 35 on the square transmission shaft 36, of which both ends are inserted into the two bias wheels 37 respectively. The two cam studs 38 of the two bias wheels 37 are engaged in two round holes 24 on both ends of the two supporting arms 23 respectively. When the bias wheels 37 rotate, the cam studs 38 become the center shaft of the two bias wheels 37. As soon as the driving power in the rotary mechanism casing 12 is coupled to the two bias wheels 37, the rotary mechanism casing 12 becomes a structure that has no fixed point. Instead, it is mounted in front of the supporting casing 11 in a suspension manner. As soon as the power of the motor 28 is transmitted to the two bias wheels 37 on both sides of the rotary mechanism casing 12, the cam studs 38 on the bias wheels 37 become a center shaft of the bias wheels 37. In other words, the driving power of the rotary mechanism casing 12 powers the casing 12 to make itself to rotate and swing.

The outer side of each bias wheel 37 on the rotary mechanism casing 12 has a convex surface 48 with a cam stud 38, of which the center is not parallel with the center line of the bias wheel 37, but is perpendicular to the convex surface 48 of the bias wheel 37. After the rotary mechanism casing 12 is connected with the supporting casing 11 through the round holes 24, the two cam studs 38 will be in a co-axial alignment. When each bias wheel 37 rotates around the cam stud 38, the rotary mechanism casing 12 will swing in a bias manner. Since the rotary mechanism casing 12 is supported with the two cam studs 38, the casing 12 will move in a rotary and swinging motion when the cam studs 38 rotate. Simultaneously, a swinging link 41 on the upper rear part of the casing 12 is mounted in the curvature slot 22 on the extension plate 21 so as to limit the swinging angle of the rotary mechanism casing 12, i.e., to have the casing 12 moved up and down and laterally in a regular manner. Thus, the swinging arms 42 on both sides of the ring-shaped belt can be moved forward to enable the animal-like skin to move and wriggle slowly.

The two symmetrical extension arms 26 on the front end of the rotary mechanism casing 12 are used for pivotally hooking the motor 28 through the ring-shaped belt 43, which has two guide grooves 44 and 45 for receiving the two extension arms 26. The extension arms 26 are set in place by means of the two guide grooves 44 and 45 respectively. When the rotary mechanism casing 12 swings, the ring-shaped belt 43 will move and swing simultaneously. Then, the swinging arms 42 will also swing to cause the two front feet 50 in the animal-like skin to move forward, and the whole animal-like toy 10 will move forward.

As shown in FIG. 3, the supporting casing 11 of the toy 10 is supported with two displacing plates 25 on both sides thereof. The rotary mechanism casing 12 is movably attached to the front end of the supporting casing 11. The ring-shaped belt 43 engaged with the two extension arms 26 has two symmetrical swinging arms 42 on both sides thereof. The swinging arms 42 can move forward upon the rotary mechanism casing swinging. As soon as the swinging arms 42 move forward, the displacing plates 25 will also be moved forward.

Figure 5:
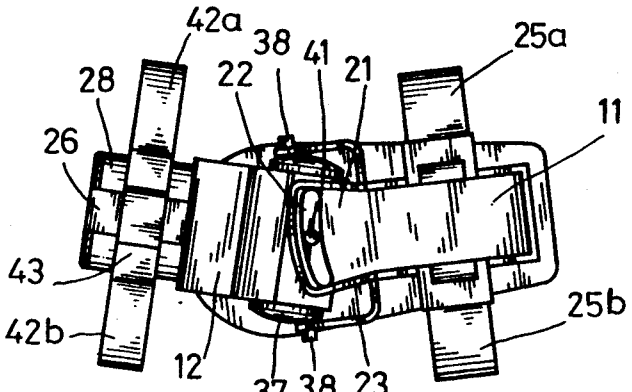
FIG. 5 is a top view of the transmission structure according to the present invention, showing the moving gesture-1 of the rotary mechanism casing.
Figure 6:
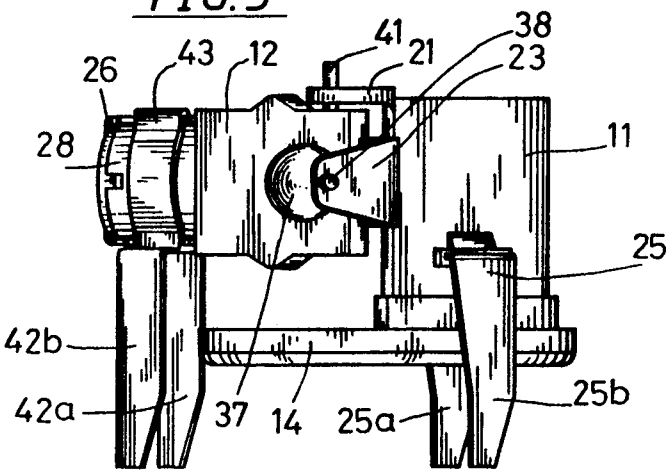
FIG. 6 is a side view of the transmission structure, showing the related parts of FIG. 5.

As shown in FIGS. 5 and 6, the animal-like toy 10 is shown in different movements. For example, FIG. 5 illustrates the rotary mechanism casing 12 swinging leftward by using, the cam studs 38 as a center line when the bias wheels 37 rotate. Simultaneously, the two foot plates 42*a* and 42*b* are in contact with the ground surface, and the swinging link 41 is in the center of the curvature slot 22, while the right displacing plate 25*a* has moved forward of the left displacing plate 25*b*.

Figure 7:
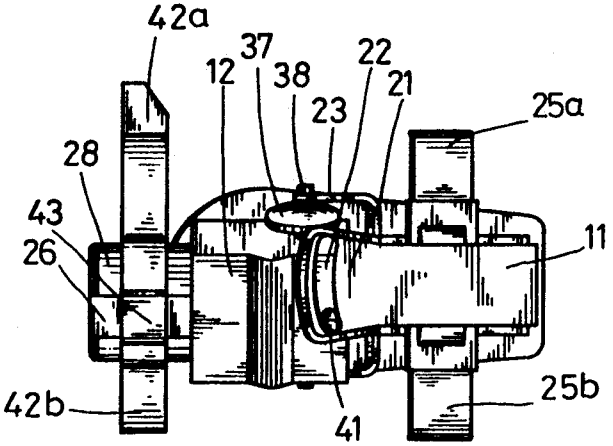
FIG. 7 is a top view of the transmission structure, showing the moving gesture-2 of the rotary mechanism casing of the present invention.
Figure 8:
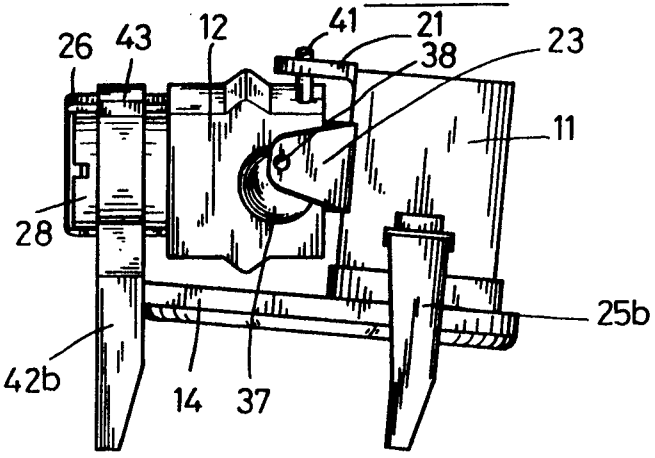
FIG. 8 is a side view of the transmission structure, showing the related parts as shown in FIG. 7.
Figure 9:
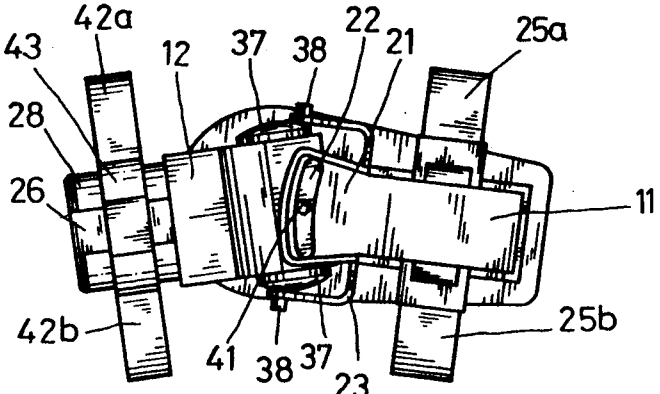
FIG. 9 is a top view of the transmission structure, showing the moving gesture-3 of the rotary mechanism casing of the present invention.
Figure 10:
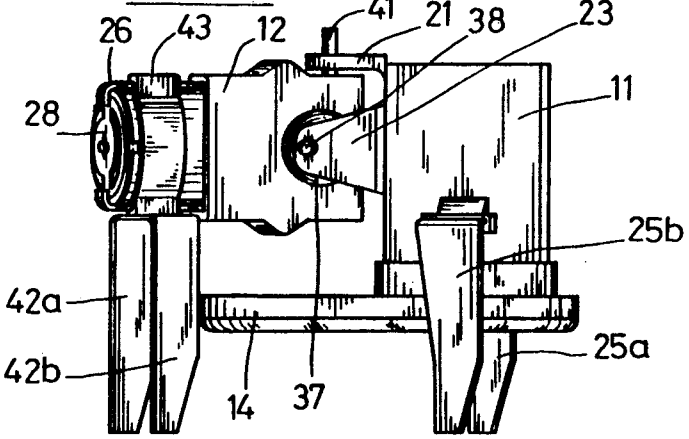
FIG. 10 is a side view of the transmission structure, showing the related parts as shown in FIG. 9.
Figure 11:
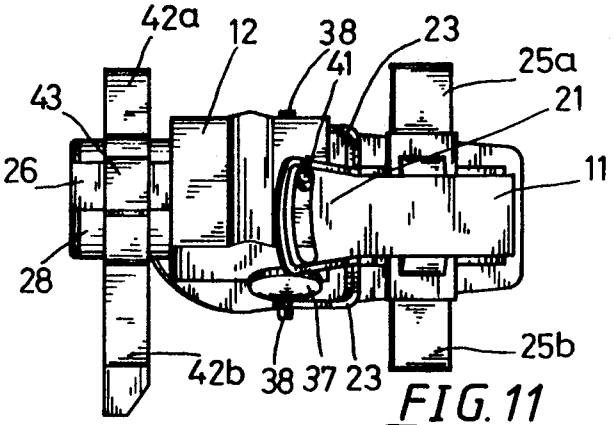
FIG. 11 is a top view of the transmission structure, showing the moving gesture-4 of the rotary mechanism casing of the present invention.
Figure 12:
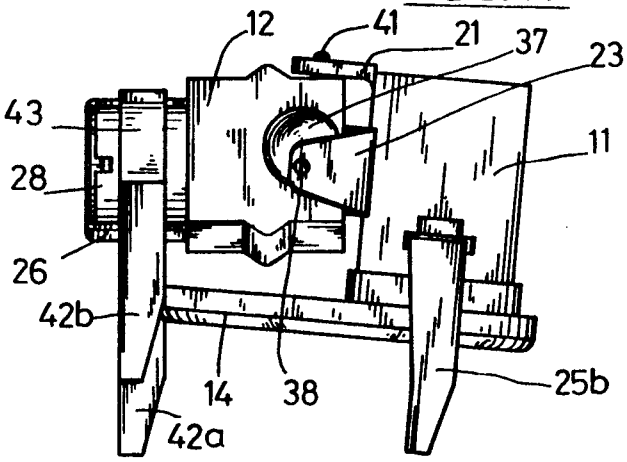
FIG. 12 is a side view of the transmission structure, showing the related parts as shown in FIG. 11.

As soon as the rotary mechanism casing 12 is driven to move and swing by the motor 28, the animal-like toy 10 as shown in FIGS. 5, 6 will move and wriggle as a result of being actuated by the two cam studs 38 of the two bias wheels 37 on both sides of the rotary mechanism casing 12. When the rotary mechanism casing 12 is driven to move by the transmission structure, the bias wheels 37 rotate clockwise. The two foot plates 42*a* and 42*b* of the swinging arm 42 originally in contact with the ground surface will be lifted by the rotary mechanism casing 12. When the right foot plate 42*a* is lifted to its highest point, it also moves forward almost at the same time. The left displacing plate 25*b* originally behind the right displacing plate 25*a* will slide and move upon the right foot plate 42*a* moving forward until reaching the state as shown in FIGS. 7 and 8, i.e., with the rotary mechanism casing 12 and the supporting casing 11 being aligned straight. Then, the swinging link 41 on the rotary mechanism casing 12 is moved to the left end of the curvature slot 22, and the front end of the supporting casing 11 is lifted up slightly. When the rotary mechanism casing 12 rotates continuously, the casing 12 and the supporting casing 11 will align straight again. Soon, the swinging link 41 will move to the right end of the curvature slot 22, while the casing 12 turns left. As soon as the right foot plate 42*a* is lifted to the highest point, it will move forward and descend to touch the ground surface. Simultaneously, the left displacing plate 25*b* also moves forward as shown in FIGS. 9 and 10, and the swinging arm 42 on the rotary mechanism casing 12 swings to the left. The left and right foot plates 42*b* and 42*a* are at a horizontal level, and the swinging link 41 is in the mid-part of the curvature slot 22. The rotary and swinging motion of the rotary mechanism casing 12 is a continuous driven to move by means of the transmission structure therein to have the right foot plate 42*a* lifted up from a horizontal point, and moved forward at a distance. In this case, the left foot plate 42*b* is used as an axis, while the right displacing plate 25*a* is used as a secondary axis. The aforesaid motion is realized by means of a wriggling motion between the rotary mechanism casing 12 and the supporting casing 11. At the same time, the left displacing plate 25*b* also moves forward at a given distance to illustrate a gesture as shown in FIGS. 9 and 10. The right displacing plate 25*a* of the rotary mechanism casing 12 will also move in the same manner as the aforesaid parts, i.e., a series of motions as shown from FIGS. 9 and 10 through FIGS. 11 and 12. Finally, they repeat the gestures as shown in FIGS. 5 and 6 to complete a series of forward motions in a wriggling manner.

As a whole, the animal-like toy 10 can move forward by means of the rotary and swinging motion of the transmission structure, in the rotary mechanism casing 12. The two cam studs 38 on the two bias wheels 37 are movably mounted to the supporting arms 23 and aligned straight on one axis. When the rotary mechanism casing 12 rotates and swings, such motion will cause the two front feet 50 to swing and move, and then the two rear feet 51 covered with the animal-like skin will also move forward. Since the animal-like skin 19 is not glued to the rotary mechanism casing 12, the animal-like skin 19 moves in a wriggling manner when the front and rear feet 50 and 51 move forward and upon the casing 12 rotating.

As shown in FIG. 3, the supporting casing 11 of the toy 10 has a bottom plate 14 mounted with a loudspeaker 20. A side plate 18 of the supporting casing is fitted with a printed circuit board (not shown) so as to generate an animal-like sound when the toy 10 moving forward.

I claim:

1. A driving structure for a toy animal having an animal-like skin including two rear feet and two front feet, which driving structure comprises:

a) a supporting casing including two displacing plates for insertion into the two rear feet, means for mounting the supporting casing to the animal skin, a pair of supporting arms at a front of the supporting casing, each supporting arm having a hole therein, and an extension plate having a curvature slot at a top front of the support casing;

b) a rotary mechanism casing, a swinging link movably engaged within the curvature slot of the extension plate, a first transmission shaft extending through opposed sides of the rotary mechanism casing, a bias wheel mounted on each of two ends of the first transmission shaft, each bias wheel having an outer convex surface and a cam stud extending outwardly therefrom, the cam studs being engaged within the holes of the supporting arms, and a pair of extension arms extending from a front of the rotary mechanism casing:

c) a motor;

d) a motor mounting means carried by the motor for engagement by the extension arms to secure the motor to the rotary mechanism casing, and two swinging arms carried by the motor mounting means for insertion into the two front feet of the skin; and e) a transmission structure disposed within the rotary mechanism casing for drivingly connecting the motor to the first transmission shaft to rotate same and impart movement to the rotary mechanism casing.

2. The driving structure of claim 1 wherein the motor mounting means includes a ring-shaped belt having two guide grooves for engagement by the extension arms, and the swinging arms are connected to and extend downwardly from the belt.

3. The driving structure of claim 1 wherein the motor includes a motor shaft provided with a screw rod and the transmission structure includes a second transmission shaft, a rotary gear and a driving gear mounted on the second transmission shaft, the rotary gear disposed in engagement with the screw rod of the motor shaft, a driven gear mounted on one end of the first transmission shaft, and the driving gear in engagement with the driven gear for rotating the first transmission shaft.

4. The driving structure of claim 1 wherein the means for mounting the supporting casing to the animal skin includes a bottom plate for disposition above an opening of the skin, a cap plate and mechanical fastening means for securing the cap plate to the bottom plate.

5. The driving structure of claim 1 wherein the supporting casing further includes a battery chamber for receiving a battery power source to operate the motor.

* * * * *